US008465143B1

(12) United States Patent
Marino et al.

(10) Patent No.: US 8,465,143 B1
(45) Date of Patent: Jun. 18, 2013

(54) SYSTEM AND METHOD FOR PRINTING ON TEXTILES

(75) Inventors: Robert Marino, Louisville, KY (US); Fred Edward Durham, III, Foster City, CA (US)

(73) Assignee: CafePress Inc., San Mateo, CA (US)

( * ) Notice: Subject to any disclaimer, the term of this patent is extended or adjusted under 35 U.S.C. 154(b) by 1029 days.

(21) Appl. No.: 12/193,710

(22) Filed: Aug. 18, 2008

Related U.S. Application Data

(60) Provisional application No. 60/956,666, filed on Aug. 17, 2007.

(51) Int. Cl.
*B41J 2/01* (2006.01)

(52) U.S. Cl.
USPC ..... 347/101; 101/41

(58) Field of Classification Search
USPC ..... 347/101; 101/41
See application file for complete search history.

(56) References Cited

U.S. PATENT DOCUMENTS

| | | | | | |
|---|---|---|---|---|---|
| 4,072,099 | A * | 2/1978 | Martin | 101/44 |
| 4,287,826 | A * | 9/1981 | Brabec | 101/115 |
| 4,669,377 | A * | 6/1987 | Ericsson et al. | 101/114 |
| 4,708,057 | A * | 11/1987 | Hogenson | 101/129 |
| 4,999,646 | A * | 3/1991 | Trask | 347/41 |
| 5,370,745 | A * | 12/1994 | Litteral | 118/669 |
| 6,276,266 | B1 * | 8/2001 | Dietz et al. | 101/41 |
| 6,312,123 | B1 * | 11/2001 | Codos et al. | 347/102 |
| 2003/0222939 | A1 * | 12/2003 | Gompertz | 347/43 |
| 2004/0189776 | A1 * | 9/2004 | Niimi et al. | 347/104 |
| 2004/0252173 | A1 | 12/2004 | Ben-Zur et al. | |
| 2006/0207448 | A1 * | 9/2006 | Fresener et al. | 101/115 |

* cited by examiner

*Primary Examiner* — Charlie Peng
*Assistant Examiner* — Peter Radkowski
(74) *Attorney, Agent, or Firm* — Nixon Peabody LLP

(57) ABSTRACT

Systems, methods and apparatuses are described for a continuous line process of printing a digital continuously variable image on a textile. The systems and methods provide for accomplishing all tasks associated with printing a textile simultaneously for multiple textiles at varying stages of the printing process without interruption.

20 Claims, 3 Drawing Sheets

SYSTEM AND METHOD FOR PRINTING ON TEXTILES

RELATED APPLICATIONS

The present application claims priority from U.S. Provisional Application Ser. No. 60/956,666 filed Aug. 17, 2007, which is incorporated herein by reference in its entirety for all purposes.

This application is related to patent application entitled "System and Method for Single Pass Printing on Textiles," Ser. No. 12/163,990, now pending, filed on Jun. 27, 2008, by inventors Robert Marino, Fred Edward Durham III and Christopher Allen Freeman; and to patent application entitled "System and Method for Improved Digital Printing on Textiles," Ser. No. 12/163,982, now pending, filed on Jun. 27, 2008, by inventors Robert Marino, Daniel L. Dilamater, and Christopher Allen Freeman, both of which are hereby incorporated by reference in their entirety. These related applications will be commonly assigned to CafePress.com, Inc.

FIELD OF THE INVENTION

The present invention relates to systems and methods for digital printing on textiles. More particularly, the present invention relates to improved systems and methods for completing ink jet digital printing on all types and colors of textiles.

BACKGROUND OF THE INVENTION

Systems and methods for ink jet printing on textiles are well known. "Direct to garment" printing provides for the production of an image by placing ink drops on the textile (garment) at distinct adjacent sites. This method of digital printing on textiles normally features an inkjet printer which applies ink on top of the textile. Herein a textile is a flexible material comprised of a network of natural or artificial fibers often referred to as thread or yarn. Yarn is produced by spinning raw wool fibers, linen, cotton, or other material on a spinning wheel to produce long strands known as yarn. Textiles are formed by weaving, knitting, crocheting, knotting, or pressing fibers together. When applied, the ink penetrates the textile saturating the fibers which is desirable for the image to be wash fast, meaning the ink does not rinse away when the textile is laundered.

Ink is delivered to the textile through print heads in a manner similar to that employed by standard inkjet printers used for printing on paper products. Changes in textile thickness, print heads settings, and image size as well as environmental changes and different weaves from different mills impact the application of the image on the textile. It is desirable to minimize the distortion or inconsistency of images. In addition, current methods do not allow a means for changing ink heads in the middle of a print process, therefore the process must be stopped, the head removed, replaced and realigned before beginning the print process again. Performing these steps is difficult and can compromise the printing of the current image. Furthermore, current methods require the use of multiple machines to complete the printing process, i.e. separate machines and personnel for pretreatment, printing and curing. Finally current systems and methods may require multiple passes to accomplish each step. The present invention provides novel systems, methods and apparatuses for a continuous line process of printing a digital continuously variable (e.g. non-repeating) image on a textile.

BRIEF SUMMARY OF THE INVENTION

In accordance with a preferred embodiment of the present invention, systems, methods and devices for continuous line printing of a digital image on a textile is provided.

In accordance with another preferred embodiment of the present invention, a method for printing directly on textiles is provided including mounting a textile on a platen, pre-treating the textile to prevent fabric saturation, digitally printing an ink layer on the textile; and curing the ink layer in a single operation.

In another embodiment of the present invention, a white ink layer is applied before digitally printing the ink layer on the textile.

In another embodiment, the digital printing is performed by an ink jet printer.

Further according to the present invention there is an apparatus for printing on the textile. The device includes a platen for holding a textile piece; at least one print head movably located above the textile piece for applying an image, a means for moving the textile through a printing process and a controller wherein the controller manipulates the means for moving the textile through the printing process and the at least one print head.

In another embodiment of the present invention, the apparatus includes at least one curing unit.

Other and further features and advantages of the present invention will be apparent from the following descriptions of the various embodiments. It will be understood by one of ordinary skill in the art that the following embodiments are provided for illustrative and exemplary purposes only, and that numerous combinations of the elements of the various embodiments of the present invention are possible.

BRIEF DESCRIPTION OF THE PREFERRED EMBODIMENTS OF THE INVENTION

DETAILED DESCRIPTION OF PREFERRED EMBODIMENTS OF THE INVENTION

Various embodiments of the invention are described hereinafter. The embodiments are not intended as an exhaustive description of the invention or as a limitation on the scope of the invention. In addition, an aspect described in conjunction with a particular embodiment of the invention is not necessarily limited to that embodiment and can be practiced in any other embodiment of the invention.

The present invention relates to systems and methods for direct printing of an image on a textile. In particular, the invention relates to direct to garment/textile image printing using digital methods. The invention is equally applicable to printing on light or white textiles as well as colored or dark textiles. When printing on a colored or dark textile it may be preferable to apply a white layer of ink prior to printing a colored image.

Figure 1A:
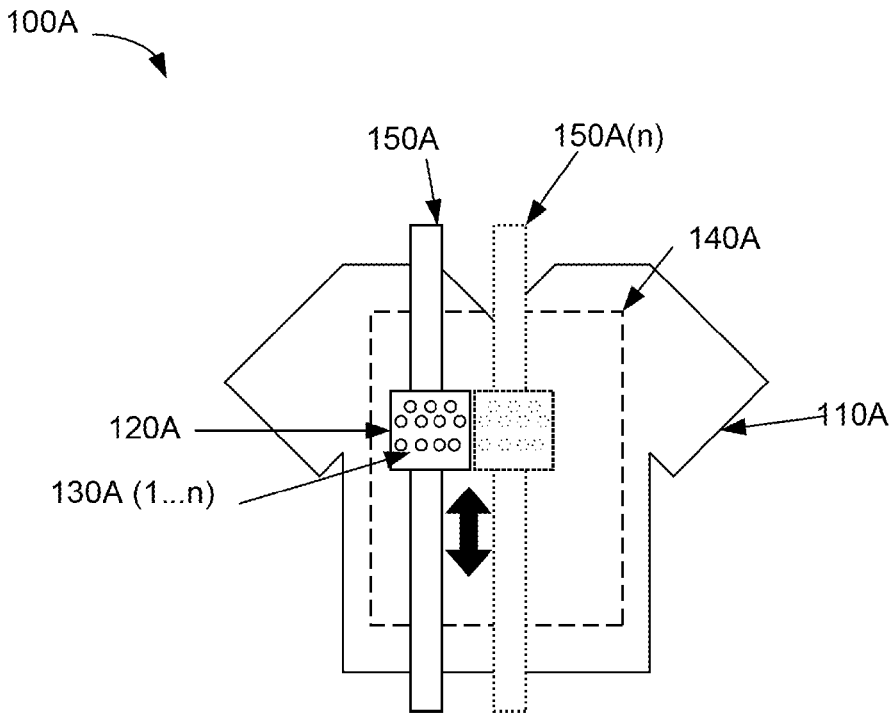
FIG. 1A is a plan view of a single head digital printer.
Figure 1B:
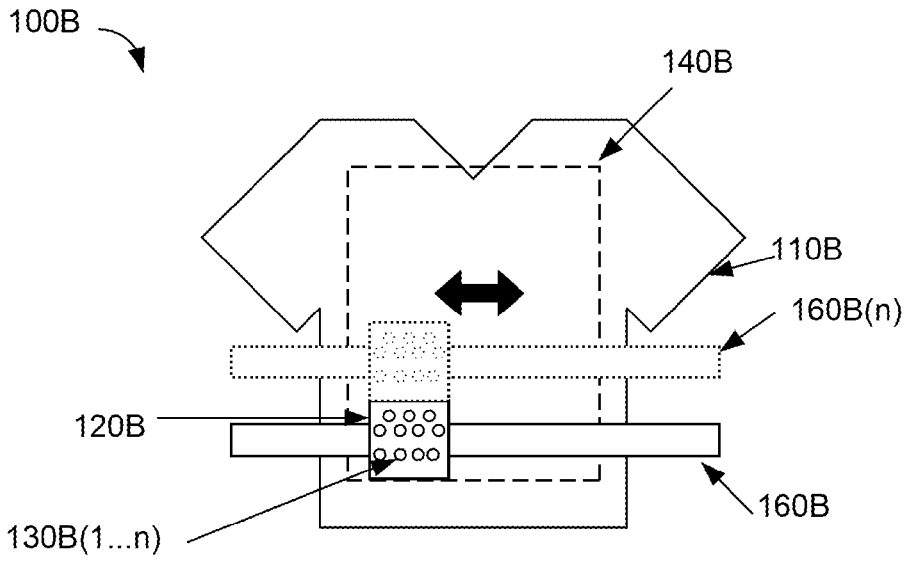
FIG. 1B is a plan view of another embodiment of a single head digital printer

Turning now to the Figures, FIGS. 1A and 1B illustrate apparatuses for digitally printing on a textile. Current printing techniques require the printing of an image to be performed on multiple mechanisms in multiple steps requiring multiple personnel to attend to each mechanism. For example, current image printing requires a mechanism having a single print head to make more than one pass over the image area in order to print the image on the textile. As a result, personnel must monitor the print process to ensure complete coverage of the textile with the desired image. Printing is then accomplished as described below in conjunction with FIG. 1.

FIG. 1A depicts the layout for a textile printer 100A. A platen, shown by the dashed rectangle 140A, is placed under the area of the textile 110A that is to receive the image. The platen area also represents the maximum print area. A print head 120A is placed above a portion of the proposed image print area. The print head 120A contains multiple nozzles 130A (1 . . . *n*). Although depicted as having eleven nozzles 130A, this is not intended to be a limitation on the number of nozzles 130A (1 . . . *n*) in the print head. Generally there numerous nozzles. In addition, there may be multiple rows of nozzles, the nozzles may also be randomly placed and/or nozzles may be located on the perimeter of the print head 120A. As is known to those of skill in the art, coupled to each nozzle is a hose (not shown). Further, as is known in the art, coupled to each hose is a cartridge or bottle of ink (not shown). The print head 120A is mounted on a controller arm (not shown) such that the print head 120A may move along a y-axis 150A parallel to the textile 110. The print head 120A makes multiple passes 150A (1 . . . *n*) to print the entire image by printing along the y-axis and then repositioning along an x-axis. However, the print head 120A performs its printing function while traveling along the y-axes 150A (1 . . . *n*). Although shown as two passes, the second in dashed lines in FIG. 1A, it could be more than two. The need for multiple passes is due to the shortness of the length of the print head.

FIG. 1B depicts the layout for a second textile printer 100B designed to work in cooperation with the textile printer 100A depicted in FIG. 1A and complements the digital printing on a textile. The second textile printer 100B improves the quality of the ink layer printing (whether the layer is merely a preparatory white ink layer or an image layer) by ensuring thorough coverage of the print area. A platen, shown by the dashed rectangle 140A, is placed under the area of the textile 110A that is to receive the image. The platen area also represents the maximum print area. A print head 120B is placed above a portion of the proposed image print area. The print head 120B contains multiple nozzles 130B (1 . . . *n*). Although depicted as having eleven nozzles 130B, this is not intended to be a limitation on the number of nozzles 130B (1 . . . *n*) in the print head. Generally there are numerous nozzles. In addition, there may be multiple rows of nozzles, the nozzles may also be randomly placed and/or nozzles may be located on the perimeter of the print head 120B. As is known to those of skill in the art, coupled to each nozzle is a hose (not shown). Further, as is known in the art, coupled to each hose is a cartridge or bottle of ink (not shown). The print head 120B is mounted on a controller arm (not shown) such that the print head 120B may move along an x-axis 160B parallel to the textile 110. The print head 120B makes multiple passes 160B (1 . . . *n*) to print the entire image by printing along the x-axis and then repositioning along a y-axis. However, the print head 120A performs its printing function while traveling along an x-axis 160B (1 . . . *n*). Although shown as two passes, the second in dashed lines in FIG. 1B, it could be more than two. The need for multiple passes is due to the shortness of the length of the print head.

While the exemplary textile printers 100A and 100B are described as working cooperatively, it is contemplated within the scope of the present invention that either one or both could work independently.

Figure 2:
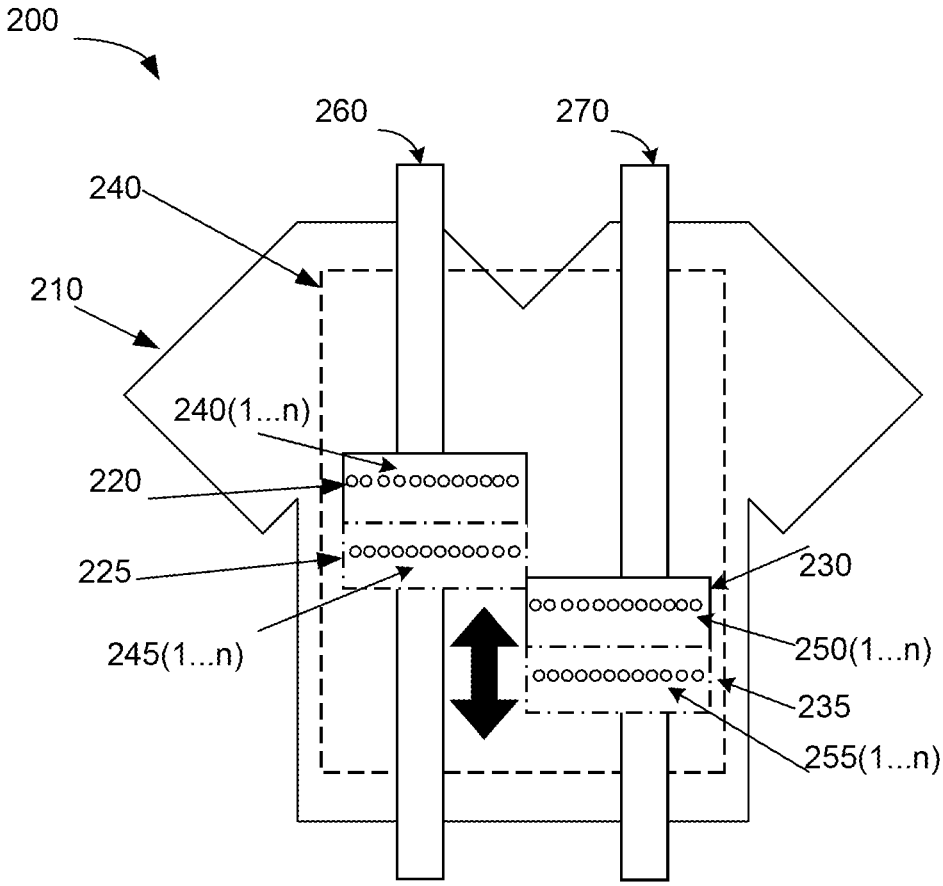
FIG. 2 is a plan view of a multi-head textile printer.

Improved printing techniques reduce the need for multiple pass printing but do not address the inefficiencies associated with multiple machines and multiple personnel. FIG. 2 illustrates one embodiment of an apparatus for improved printing on a textile 200. A platen, shown by the dashed rectangle 240, is placed under the area of the textile 210 that is to receive the image. The platen area also represents the maximum print area. At least two print heads 220, 230 are placed above a portion of the proposed image print area. The at least two print heads are placed in a horizontal arrangement across the textile 210. The at least two print heads 220, 230 each contain multiple nozzles 240 (1 . . . *n*), 250 (1 . . . *n*). Although depicted as having twelve nozzles 240(1 . . . *n*), 250 (1 . . . *n*) this is not intended to be a limitation on the number of nozzles 240(1 . . . *n*), 250 (1 . . . *n*) in the print heads. Generally there numerous nozzles. In addition, there may be multiple rows of nozzles, the nozzles may also be randomly placed, and/or the nozzles may be located on the perimeter of the print heads 220, 230. As is known to those of skill in the art, coupled to each nozzle is a hose (not shown). Further, as is known in the art, coupled to each hose is a cartridge or bottle of ink (not shown). The print heads 220, 230 are mounted on a controller arm (not shown) such that the print heads 220, 230 may each move along its own y-axis 260, 270 parallel to the textile 210. The axis may be in the center of the print head or offset in any distance so desired. The print heads 220, 230 therefore work together making a single pass 280 to print the entire image. While shown as having two print heads 220, 230 in an array, there could be more than two print heads (as shown optionally by the additional print heads 225, 235 in dashed lines each having nozzles 245 (1 . . . *n*), 255 (1 . . . *n*)). Any number of multiple print heads arranged individually or in arrays is contemplated within the scope of the present invention. If the print heads are arranged in two across however, preferably, the total number of print heads is a multiple of two. Nevertheless, although not shown, more than two print heads across is contemplated within the scope of the present invention. By having multiple heads, an image can be printed in one pass allowing for greater efficiency. In addition, printing in one pass, reduces the likelihood of distortion from potential movement of the textile or misalignment of the print head(s). Furthermore, when multiple arrays of print heads are employed, the ink bottles or cartridges can be changed during the print process without requiring the process to be paused. Furthermore, if a nozzle on a print head clogs, the printing can be completed by a second array adjacent to the print head containing the clogged nozzle.

Figure 3:
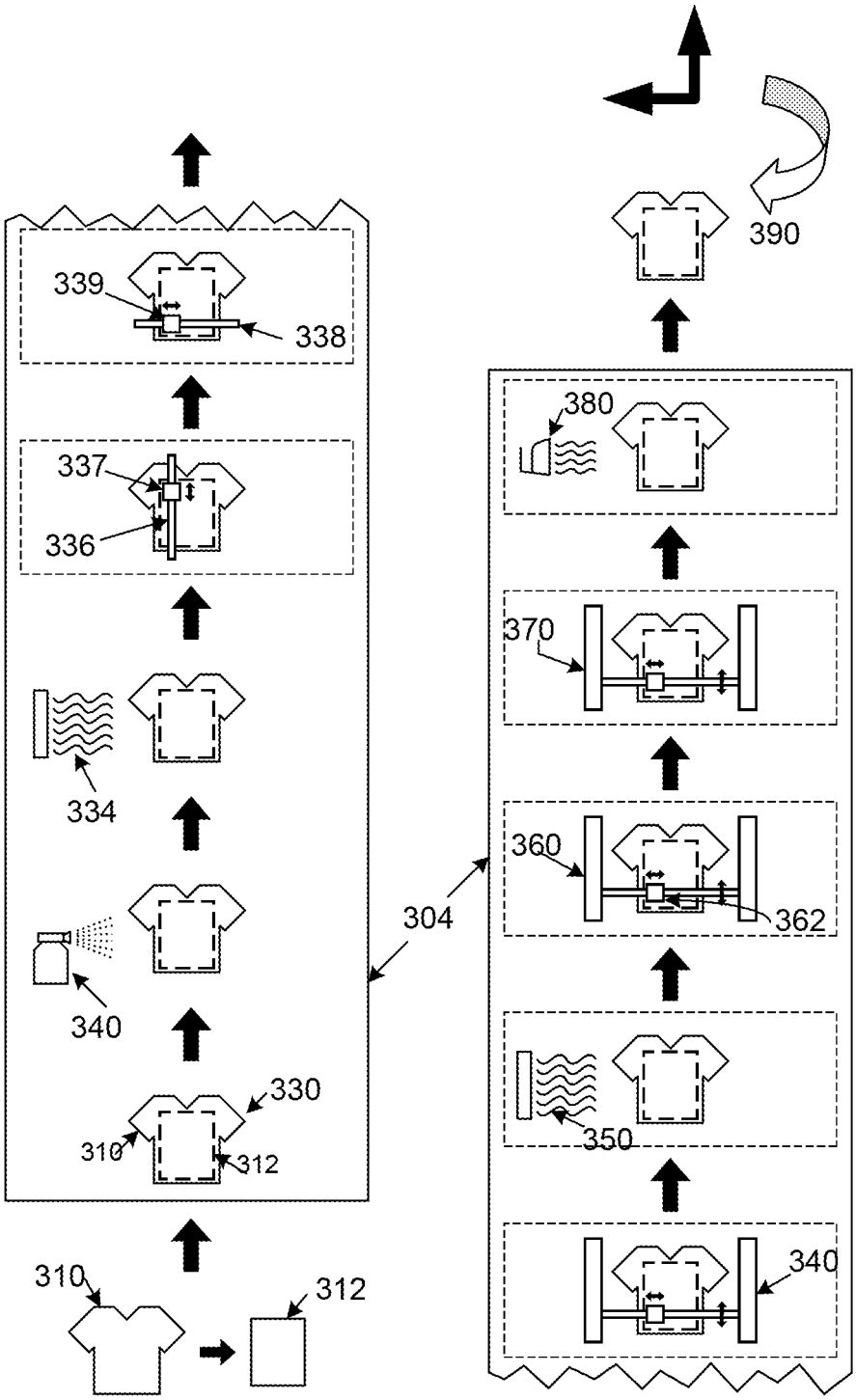
FIG. 3 is a plan view of an assembly for digitally printing a textile.

While methods such as those described in conjunction with FIG. 2 improve the printing on textiles, there is still a need to improve the efficiency of the entire printing process, including any pretreatment and curing. Moreover, it is desirable to facilitate printing a variety of images without having to reset and reprogram a printing line. FIG. 3 illustrates a plan view of an assembly for digitally printing images on white and dark textiles. A continuous line is a novel way to provide the greatest efficiency of printing multiple print jobs without requiring modification to the equipment or set up. By utilizing novel digital printing capabilities, the assembly provides novel systems, methods and apparatuses for a continuous line process of printing a digital continuously variable (e.g. non-repeating, distinct) image on a textile. As shown, an assembly 300 provides a means and apparatus for automating the digital imprinting processes. The assembly includes a means for conveying 304 a textile 310 through the printing process. The means for conveying may include a gear driven mechanism, a belt driven mechanism, a chain driven mechanism or any other mechanism known or contemplated in the art. The means for conveying 304 may be designed to pause at each step/location of the printing process to allow the process to be completed. Alternatively, the means for conveying may not pause but may move at a speed designed to allow the process to be completed before the next process begins. For example during a curing process the conveying means may move the textile mounted on the platen instead of the curing mechanism itself moving. The means for conveying 304 is manipulated by a controller (not shown). The conveyor means provides a mechanism designed to transport a textile or objects in a predetermined path and has fixed or selective points of loading or discharge. However, the stations along the conveying means may vary depending upon the pretreatment or printing applications utilized. Furthermore, while depicted as progressing in a single direction in the present embodiment, the conveying means may progress in multiple directions (i.e., forward and reverse). Once the controller is started, the conveying means transports the textile 310 automatically through the various printing mechanism stations without further intervention by an individual. The controller may be the same controller that manipulates the various mechanisms along the means for conveying, or it may be a separate controller that only operated the means for conveying. The conveying means automatically, without the need for personnel, moves the textile through the printing process as described in further detail below.

In the assembly 300 presented a textile 310 is mounted/placed onto a platen 312. Mounting the textile on the platen may be done manually or in an automated process for example an order management system may be implemented. The textile 310 mounted on the platen 312 proceeds as one unit on the means for conveying 304. As a result it is not necessary to remove or adjust the textile during the printing process. In contrast to conventional printing techniques, the platen 312 with the textile 310 mounted on it moves through the various printing and processing mechanisms. The platen 312 with the textile 310 is then loaded 330 onto the means for conveying 304 at a first location. In the assembly 300 of FIG. 3, the first location is shown as just prior to a pretreatment mechanism. This first station is not intended to be a limitation of the present invention. It is contemplated within the scope of the present invention that the first location could be anywhere along the conveying means. The loading may be done manually, or through an automated process utilizing an order management system. The mounting and loading process is performed on a continual basis so that at any point in time there are multiple platens 312 each having a textile 310 mounted on it moving along the means for conveying 304 with each textile 310 undergoing a stage of the printing process. Once on the means for conveying 304, the platen 312 with the textile 310 mounted on it is conveyed through the assembly 300 resulting at the end in the printing of an image on the textile 310. In this embodiment of the present invention, in novel fashion the textile 310 remains mounted on the same platen through the entire printing process thus reducing the likelihood of distortion or imperfection of the printed mage that may be associated with loading and unloading textiles.

The conveying and printing process begins by transporting the textile 310 mounted on the platen 312 by the means for conveying 304 to a mechanism for pre-treating the textile 340. While it may be preferable to pretreat the textile, embodiments of the present invention may optionally not include pretreatment. The pretreatment process may include the application of a liquid solution to prevent the ink from over saturating the textile. Such application may include but is not limited to a spray, roll, or jet. Exemplary pretreatment processes include but are not limited to those described in U.S. patent application Ser. No. 12/163,982 which is hereby incorporated by reference in its entirety. The pretreatment process may require curing of the liquid solution. If curing is required, the textile 310 mounted on the platen 312 continues along the means for conveying to a mechanism for curing 334. The pretreatment cure process may be accomplished in any conventional manner, such as UV curing lamp, infrared, hot air, a combination of pressure and heat, or baking depending on the pretreatment process employed. The time and pressure for curing the liquid solution may vary with the quantity and chemistry of the liquid solution applied to the textile. Although described as continuing along the means for conveying, one of skill in the art will appreciate that a curing unit may be included on the device performing the pretreatment, in which case the textile 310 need not continue along the means for conveying for curing the pretreatment solution. Furthermore the pretreatment process may also include other treatments as known to those skilled in the art.

Once the pretreatment process 340 is complete, the textile 310 mounted on the platen 312 continues along the means for conveying 304 to a mechanism for applying a white ink layer if desired. A white ink layer is applied most often when printing on a dark textile. It is preferable to apply at least one white ink layer when printing on colored textiles however, printing a white ink layer is optional and embodiments of the present invention may omit the white ink layer. If a white ink layer is not needed the application of the white ink layer may be omitted. The white ink layer may be applied by a first single inkjet print mechanism 336. FIG. 1A is an exemplary single ink jet print head mechanism for use in the present embodiment. The single print head mechanism 336 provides for the application of a first coat of white ink on the desired print area with the print head traveling along a "y-axis", i.e., the axis that runs from the top of the textile to the bottom of the textile along a north/south line. The print head 337 of the first single inkjet print head 336 moves along a bar or other guiding means along the y-axis. The y-axis guiding means may also move across the textile along an x-axis after each y-axis pass so that a solid white ink layer is created.

After the application of a first white ink layer, the textile 310 mounted on the platen 312 continues along the conveying means to a mechanism for applying a second white ink layer 338. The second white ink layer is optional and may or may not be applied depending on the textile and the type of digital printing. If a second white ink layer is desired, the second white ink layer is preferably, but not necessarily, applied in a distinct pattern or direction from the first white ink layer to ensure coverage of the entire print area. FIG. 1B is an exemplary second single ink jet print head mechanism for use in the present embodiment. The second white ink layer may be applied by a second single inkjet print head mechanism 338. The print head 339 of the second single inkjet print head mechanism 338 provides for the application of a second coat of white ink on the desired print area with the print head traveling along an "x-axis", i.e., the axis that runs across the textile from side to side along an east/west line. The print head 339 of the second single inkjet printer mechanism 338 moves along a bar or other guiding means along the x-axis. The x-axis guiding means may also move across the textile along a y-axis after each x-axis pass so that a solid white ink layer is created. Although shown as a distinct mechanism from the first mechanism for applying a white ink layer it is contemplated within the scope of the present invention that the second white ink layer could be applied by the same mechanism as is utilized to apply the first white ink layer if the mechanism is so adapted and vice-versa. Furthermore while described as creating the ink layer first in the north-south direction and then in the east-west direction such order of coating is not a limitation on the embodiment of the present invention and the white ink layer could be created following any directional path or pattern that results in the print area being covered with the white ink.

After the application of the white ink layer or layers, a redundant white ink layer mechanism 340 is provided in the event that there are imperfections or faults in the white ink layer(s) may need to be corrected. The redundant white ink layer mechanism while preferably included is optional and may be omitted in embodiments of the present invention. The redundant mechanism provides for applying a white ink layer in any direction or pattern necessary to ensure the print area is properly covered with white ink. The textile 310 mounted on the platen 312 then continues along the means for conveying 304 to a mechanism for curing 350 the white ink layer(s). The white ink layer(s) cure process may be accomplished in any conventional manner, such as UV curing lamp, infrared, hot air, a combination of pressure and heat, or baking depending on the ink process employed. The time and pressure for curing the liquid solution may vary with the quantity and chemistry of the liquid solution applied to the textile. Although described as continuing along the means for conveying, one of skill in the art will appreciate that a curing unit may be included on the device performing the printing, in which case the textile 310 mounted on the platen 312 need not continue along the means for conveying, or the curing may be done by a separate device as described. When printing white or light colored textiles it may not be necessary to print a white ink layer. If a white ink layer is not needed the assembly controller (not shown), which controls the operation of the various mechanisms along the assembly 300, may be programmed to bypass the white ink mechanisms alternatively, the assembly 300 may be constructed without the mechanisms for printing and curing white ink layers.

The first, second and/or redundant white ink layers may be complete backgrounds for the image print area or any portion thereof depending on the design of the image to be printed on the garment and the desired aesthetic effect. For example, it may be desirable to print all colors that appear in an image; alternatively, it may be desirable to allow the color of the textile itself to be part of the image. Furthermore, it may be desirable to have a single white ink layer on some portions and multiple white ink layers on other portions of the garment where the image is to be printed. Such variations in the white ink layer are provided for and contemplated within the scope of embodiments of the present invention.

The application and curing of the white ink layer is optional as disclosed above. After the application and curing of the white ink layer(s) the textile 310 mounted on the platen 312 continues along the means for conveying 304 to a mechanism for printing or applying an image 360 on the textile 310 which may or may not including printing on the white ink layer. If the white ink layer is omitted, the textile 310 mounted on the platen 312, continues to a mechanism for printing an image 360 without having received a white ink layer. The mechanism for printing an image 360 on the white ink layer preferably features a single inkjet print head 362 such as that described in conjunction with FIG. 1A or 1B. Alternatively, other ink printers may be utilized to print the image on the white ink layer or directly on the textile. For example novel double array head printers could be used such as that described in FIG. 2 or U.S. patent application Ser. No. 12/163,990 entitled "System and Method for Single Pass Printing on Textiles." The double array print heads provide for speed and redundancy in one mechanism. Should one head in the team of heads have a clogged jet (clogged jets stop or restrict ink coverage) the redundant head will help cover the missing section. Such processes are described in U.S. patent application Ser. No. 12/163,990, which is hereby incorporated by reference in its entirety. If a single ink jet head 362 is utilized, the printing is accomplished in a manner similar to the method for printing the white ink layer described above. However, when printing the image layer, a second layer is not necessary, but may be provided as a redundant inkjet print mechanism 370 so that any imperfection or faults in the image ink layer may be corrected. The redundant ink jet print mechanism 370 provides for applying the image ink layer in any direction or pattern necessary to ensure the print area is properly covered with the image. The color print head is preferably a CMYK print head although other print heads including those capable of printing metallic images are contemplated in the scope of the present invention.

The assembly 300 is a continuous line therefore it is important that the line be capable of running when a head malfunctions or needs maintenance. Thus, the redundant print head, while optional is highly beneficial in ensuring continual operation. Continual operation is important otherwise the purpose of the assembly 300 is frustrated. The double array print mechanism, with or without a redundant print assembly, also allows the line to continue to operate, although at a slower rate during maintenance or repair operations. In addition or instead of a redundant print head, an alternative print head capable of printing metallic or other types of ink images (i.e., "puffy" ink, or stylized ink) may be included in the assembly 300. Such printers may print a second layer on top of the first image layer to create the final image.

After printing, the textile 310 mounted on the platen 312 continues along the means for conveying 304 to a mechanism for curing 380 the color or image ink layer. The color ink layer cure process may be accomplished in any conventional manner, such as UV curing lamp, infrared, hot air, a combination of pressure and heat, or baking or a combination of the aforementioned curing processes depending on the ink process employed. The time and pressure for curing the color ink layer may vary with the chemistry of the ink applied to the textile. Although described as continuing along the means for conveying, one of skill in the art will appreciate that a curing unit may be included on the device performing the printing, in which case the textile 310 mounted on the platen 312 need not continue along the means for conveying but rather may be cured at the location of the image printing.

After the printing and curing of the image on the textile 310 is complete, the textile 310 mounted on the platen 312 continues along the means for conveying 304 to an offloading area 390. The offloading may be done manually or automatically. A mechanism (not shown) manipulated by a controller may be provided for removing the platen from the conveying means. Once at the offloading area, the textile 310 may be removed from the platen 312 and the printing process is complete. Similarly, removing the textile from the platen may be performed manually or automatically. If an automated system is used, the same mechanism that removes the platen from the conveying means may remove the textile from the platen or distinct/alternate mechanism may perform the task. Alternatively, the platen 312 may be rotated 354 so that the back side of the textile 310 may be printed. The platen 312 could also be repositioned such that another surface of the textile 310 may be printed on. If printing the backside is desired, the textile 310 mounted on the platen 312 is run through the assembly for a second time as described above. Similarly, if the textile is a shirt or other garment, the platen could be adjusted for printing on a sleeve or any other location and the process described above may be repeated for the additional print location.

Each of the mechanism described above, i.e., pretreatment, curing, printing, and offloading, is preferably moveably located along and above the conveying means so that the platen mounted with the textile passes under or through the mechanism performing the processes.

While the assembly is described as being comprised of a single textile printer type, multiple different textile printers and printer types may be utilized within a single assembly and are contemplated within the scope of the present invention. The inkjet or digital printer type is not limited to those described in the embodiment but rather all such printers are within the scope of the present invention. Further, other variations of printers and printer types are within the scope of the present invention, but preferably such printers have the ability to print continually variable repeating and non-repeating images. Furthermore, while described as printing an image, i.e. the printing mechanism creating the image at the time the printing is performed, devices that apply an image, i.e., the image is pre-constructed and applied as a whole, are also contemplated within the scope of the present invention.

The assembly 300 operates in a novel way. The assembly 300 separates the platen (the base the textile is mounted on prior to printing) from the print mechanisms and therefore allows multiple textiles mounted on multiple platens to be processed through a printing cycle simultaneously. The platens are driven by a conveyor means through the various steps/components of the line.

In a preferred embodiment, a controller controls the conveying of the textile mounted on the platen through the assembly as well as the entire printing process (pretreatment, application of the white ink layer or layers, curing of the white ink layer(s), printing of the image and curing of the image). Alternatively, two or more controllers may be employed. In the latter instance, preferably one controller manages the means for conveying and the other controller(s) manage the various mechanisms required for the printing process.

A system for direct to garment/textile printing on a textile is also disclosed. The system includes a conveyor system, at least one platen for holding a textile piece, wherein the platen is a distinct element of the system, at least one inkjet print head movably located above the textile piece for applying an ink layer, a curing unit moveably located above the textile piece and at least one controller coupled to the system. The controller manipulates the means for conveying and the at least one ink jet head for applying the ink layer and the curing unit.

The system may also include a pretreatment mechanism having a means for applying a liquid solution to the area of the textile on which the image will ultimately be printed, at least one second inkjet print head above the textile piece for applying a white ink layer and a curing unit located above the textile piece, each of these also managed by the controller. The means for applying the liquid pretreatment solution may include but is not limited to a spray, roll, or jet.

Alternatively, the system may include multiple controllers, each controller designed to manage a separate aspect of the system.

A method for direct to garment/textile printing is further disclosed. The method includes mounting a textile on a platen, placing the platen on a means for conveying and automatically conveying the textile along a continuous line so that the textile is exposed to any selection of the steps of the printing process described above, after which the platen is removed from the means for conveying and the method is optionally repeated on the textile.

Each of the systems, methods and apparatuses preferably includes multiple separable platens, i.e., each platen is a separate article from the machine, so that multiple textiles can be run through the system simultaneously each one mounted on its own separate platen allowing the assembly to operate in a continuous manner. In this way, there will be a textile at each phase of the printing operation at most times. As a result, the pretreatment, curing and printing mechanisms all are capable of operating simultaneously. In addition, multiple pretreatment, printing and curing mechanisms along the means for conveying may be desired to complete the printing process in the most efficient manner and are contemplated within the scope of embodiments of the present invention.

While the system and apparatus described above includes all required mechanisms for completing the printing process. It is contemplated within the scope of the present invention that one or more mechanism could be removed from the means for conveying. For example, a conveyor system having only the pretreatment, printing and curing mechanisms is included within the scope of the present invention.

Furthermore, although described as having multiple mechanisms along the conveying means, it is contemplated within the scope of embodiments of the present invention that there may be more or fewer mechanisms to accomplish the textile printing. In addition the system may be constructed such that individual mechanisms may be physically added or removed as desired in a modular style system. Alternatively the assembly may be constructed with a fixed set of mechanisms and one or more controller where the controller(s) may be used to control which mechanisms are in operation for any given printing process. In this latter embodiment, the textile mounted on the platen may merely pass through, without undergoing any process, any station without the purpose of the station being realized.

As noted previously the forgoing descriptions of the specific embodiments are presented for purposes of illustration and description. They are not intended to be exhaustive or to limit the invention to the precise forms disclosed and obviously many modifications and variations are possible in view of the above teachings. The embodiments were chosen and described in order to explain the principles of the invention and its practical applications, to thereby enable those skilled in the art to best utilize the invention and various embodiments thereof as suited to the particular use contemplated. It is intended that the scope of the invention be defined by the claims and their equivalents.

The invention claimed is:

1. A method for printing an image on a textile comprising:

mounting a textile on a platen;

placing the textile mounted on the platen at a first location on an automatic conveying means;

conveying the textile mounted on the platen to a print pretreatment mechanism pretreating the textile mounted on the platen;

conveying the pretreated textile mounted on the platen to a curing mechanism;

conveying the pretreated textile mounted on the platen to a printing mechanism;

printing, with a single pass printing system, an image on the textile mounted on the platen, the single pass printing system including at least two print heads, each print head including multiple nozzles, the at least two print heads moving relative to the textile only along a single axis and printing the entire image on the textile in no more than a single pass over the textile;

conveying the textile mounted on the platen with a printed image to a curing mechanism;

curing the printed image on the textile mounted on the platen;

conveying the textile mounted on the platen with a printed image to an offloading area; and offloading the textile from the platen.

2. The method of claim 1, further comprising:

conveying the textile mounted on the platen to a mechanism for printing a white ink layer;

printing at least one white ink layer on the textile mounted on the platen; and curing the at least one white ink layer on the textile mounted on the platen.

3. The method of claim 2, wherein printing the at least one white ink layer includes printing a first white ink layer and a second white ink layer on the textile mounted on the platen, wherein the second white ink layer is applied in a distinct pattern or direction from the first white ink layer.

4. The method of claim 1, further comprising printing a second image on the pretreated area of the textile.

5. The method of claim 4 wherein the image and the second image are the same.

6. The method of claim 1 further comprising:

rotating the platen with the textile mounted on the platen while at the offloading area; and returning the rotated platen with the textile mounted on the platen to the first location on the automatic conveying means.

7. A system for direct to garment printing comprising:

a platen for mounting a textile undergoing a printing process;

a means for conveying the platen mounted with the textile through the printing process;

a mechanism for pretreating an area of the textile, the mechanism for pretreating being located along the conveying means;

a mechanism for curing the area of the textile after pretreating the area of the textile, the mechanism for curing being located along the conveying means;

a single pass printing system for printing an image on the pretreated area of the textile the mechanism for printing an image being located along the means for conveying, the single pass printing system including at least two print heads, each print head including multiple nozzles, the at least two print heads moving relative to the textile only along a single axis and printing the entire image on the textile in no more than a single pass over the textile;

a mechanism for curing the image on textile the mechanism for curing the image being located along the means for conveying; and a mechanism for offloading the platen mounted with a textile from the means for conveying.

8. The system of claim 7, further comprising:

a first mechanism for printing a first white ink layer on the pretreated area of the textile, the mechanism for printing a first white ink layer being located along the means for conveying; and a mechanism for curing the white ink layer, the mechanism for curing the white ink layer being located along the means for conveying.

9. The system of claim 8, further comprising:

a second mechanism for printing a second white ink layer on the pretreated area of the textile, the second mechanism for printing a second white ink layer being located along the means for conveying, the second mechanism for printing a second white ink layer applying the second white ink layer in a distinct pattern or direction from the first white ink layer applied by the first mechanism for printing a first white ink layer.

10. The system of claim 7, further comprising:

a redundant print mechanism for printing an image on the pretreated area of the textile.

11. The system of claim 7, further comprising:

a mechanism for rotating the platen after for offloading the platen mounted with a textile from the means for conveying.

12. An apparatus for printing on a textile comprising:

a platen for holding a textile;

a conveying means for positioning the platen holding the textile;

a mechanism for pretreating the textile, wherein the mechanism for pretreating the textile moveably located above the conveying means;

a first curing unit to cure the pretreated textile, wherein the first curing unit is moveably located above the conveying means;

a single pass printing system for printing an image on the textile, wherein the single pass printing system is located above the conveying means, and the single pass printing system includes at least two print heads, each print head including multiple nozzles, the at least two print heads moving relative to the textile only along a single axis and printing the entire image on the textile in no more than a single pass over the textile;

a second curing unit to cure the printed image, wherein the second curing unit is moveably located above the conveying means; and a controller wherein the controller manipulates the conveying means for positioning the platen holding the textile, the mechanism for pretreating the textile, the first and the second curing units and the at least two print heads.

13. The apparatus of claim 12, wherein the first curing unit and the second curing unit are the same unit.

14. The apparatus of claim 12, further comprising:

at least one print head for printing a white ink layer on the textile, wherein the print head is movably located above the conveying means;

a third curing unit to cure the white ink layer, wherein the third curing unit is moveably located above the conveying means;

wherein the controller manipulates the at least one print head for printing a white ink layer and the third curing unit.

15. The apparatus of claim 14, wherein the third curing unit and the second curing unit are the same unit.

16. The method of claim 1, wherein the single pass printing system includes multiple arrays of print heads.

17. The method of claim 1, wherein printing the image on the textile includes printing the image where one of the print heads is not operating.

18. The system of claim 7, wherein the single pass printing system includes multiple arrays of print heads.

19. The system of claim 7, wherein the single pass printing system prints the image on the textile where one of the print heads is not operating.

20. The apparatus of claim 12, wherein the single pass printing system prints the image on the textile where one of the print heads is not operating.

* * * * *